United States Patent [19]

Yamaguchi

[11] Patent Number: 4,882,988

[45] Date of Patent: Nov. 28, 1989

[54] SHEET POSITIONING APPARATUS FOR SHEET-FED ROTARY PRINTING MACHINE

[75] Inventor: Yuji Yamaguchi, Mino, Japan

[73] Assignee: Sakurai Machine Trading Co., Ltd., Tokyo, Japan

[21] Appl. No.: 115,077

[22] Filed: Oct. 29, 1987

[30] Foreign Application Priority Data

Nov. 1, 1986 [JP] Japan ..... 61-261514
Feb. 5, 1987 [JP] Japan ..... 62-25391

[51] Int. Cl.[4] ..... B65H 9/00; B41F 21/12; B41F 21/14

[52] U.S. Cl. ..... 101/232; 271/236; 271/244; 271/248

[58] Field of Search ..... 101/232, 246, 240, 241; 271/248, 236, 244, 249, 250, 252

[56] References Cited

U.S. PATENT DOCUMENTS

| | | | |
|---|---|---|---|
| Re. 9,239 | 7/1977 | Terzuolo et al. | 101/232 |
| 1,299,920 | 4/1919 | Droitcour | 271/236 |
| 1,300,562 | 4/1919 | Blaine | 271/236 |
| 1,340,723 | 5/1920 | Leonard | 271/244 |
| 2,395,444 | 2/1946 | Belluche | 271/244 |
| 2,412,132 | 12/1946 | Dell | 101/232 |
| 2,593,148 | 4/1952 | Huck | 271/250 X |
| 2,809,831 | 10/1957 | Nordquist | 271/250 X |
| 3,948,509 | 4/1976 | Becker | 271/248 X |
| 4,771,691 | 9/1988 | Sakurai et al. | 101/232 X |

FOREIGN PATENT DOCUMENTS

| | | |
|---|---|---|
| 3004314 | 8/1981 | Fed. Rep. of Germany . |
| 58-151043 | 10/1983 | Japan . |
| 61-132348 | 6/1986 | Japan . |

OTHER PUBLICATIONS

Patent Abstract of Japan JP-61-132348, Copy of European Search Report.

*Primary Examiner*—Clifford D. Crowder
*Attorney, Agent, or Firm*—Jordan and Hamburg

[57] ABSTRACT

A sheet-fed rotary printing machine having an impression cylinder, rotary members movable in accordance with the motion of the impression cylinder, a paper cassette disposed near the impression cylinder for containing a stack of sheets of printing paper, and a feed member for holding each sheet of the printing paper by suction from above to feed it directly to a predetermined position on the impression cylinder. The feed member feeds the printing paper to the outer circumference of the impression cylinder by means of a vertically moving mechanism and a horizontally moving mechanism. Also, the feed member moves in synchronization with the rotation of the impression cylinder by means of a first timing mechanism and a second timing mechanism.

5 Claims, 14 Drawing Sheets

SHEET POSITIONING APPARATUS FOR SHEET-FED ROTARY PRINTING MACHINE

BACKGROUND OF THE INVENTION

1. Field of the Invention

The present invention relates to a sheet-fed rotary printing machine.

2. Description of the Related Art

In general, in printing of the type employing such a sheet-fed rotary printing machine, the position of printing paper on the outer circumference of an impression cylinder is significantly important in order to achieve accurate printing without involving any dislocated printing or doubled printing. Therefore, before the printing paper is fed to the bottom of the blanket cylinder, it is necessary to feed the printing paper to a predetermined position on the outer circumference of the impression cylinder.

In order to meet the above-described requirement, the following type of printing machine is widely employed.

As shown in FIG. 20, the illustrated printing machine generally includes an impression cylinder 61, a paper cassette 62 disposed in face-to-face relationship therewith, and an endless belt 63 disposed between the components 61 and 62 for feeding printing paper P. Sheets of printing paper P are stacked in the paper cassette 62, and a suction member 64 is disposed for vertical movement above the paper cassette 62. Each sheet of the printing paper P is held by the suction member 64 by suction to carry it to the feed belt 63. When the printing paper P is transported to one end of the feed belt 63, the printing paper P is pressed into contact with the belt 63 by means of a feed roller 65, and the suction through the suction member 64 is cancelled to feed the printing paper P toward the impression cylinder 61. In addition, the printing paper P is fed to a paper feed member 66, and each sheet of the printing paper P is properly registered by position limiting plates 67 disposed upright on opposite sides of of the paper feed member 66, thus being fed to a predetermined position on the outer circumference of the impression cylinder 61. Thereafter, the printing paper P is held against the outer circumference of the impression cylinder 61 by a retention pawl 68. Then, as the impression cylinder 61 rotates, the printing paper P moves to a predetermined position on the impression cylinder 61 which is maintained in contact with the bottom of the blanket cylinder 69 so that printing is effected.

The above-described related art printing machine, however, involves the following problems.

The suction member 64, the feed belt 63, and the paper feed member 66 constitute in combination means for feeding the printing paper from the paper cassette to the outer circumference of the impression cylinder. Accordingly, the number of parts needed increases and hence the size of the printing machine increases. This may result in an increase in production cost.

The printing paper P is supplied from the suction member 64 to the feed belt 63 with the printing paper P being pressed in contact with the feed belt 63 by the feed roller 65. This pressure may cause damage to a surface of the printing paper P.

FIG. 23 shows another example of this conventional type of sheet-fed rotary printing machine. In this example, a recess 92 is formed in the outer circumference of an impression cylinder 91, and a support shaft 93 having a plurality of gripping pawls 94 (only one of which is shown) is disposed in the recess 92, with the support shaft 93 being capable of rotating to-and-fro. The arrangement of such a printing machine is such that the leading edge of the printing paper P supplied from a paper supply table 95 is gripped by each of the gripping pawls 94. As the impression cylinder 91 rotates, the printing paper P is subject to printing by means of a blanket 96a laid over a blanket cylinder 96.

In such an arrangement, a margin of the printing paper P which is adjacent to its leading edge is employed as a margin which is directly gripped by the gripping pawls 94. It is therefore impossible to effect printing onto this margin. Accordingly, there is a problem in that it becomes impossible to effect printing over the entire surface of the printing paper P.

In order to solve the above-described problems, the present applicant proposed the following printing machine in Japanese Patent Laid-open No. 132348/1986.

As shown in FIG. 21, this printing machine includes an impression cylinder 81 having an outer circumferential surface through which a plurality of air passage holes 82 are formed, and the air passage holes 82 communicate with an air passage 83 formed within the impression cylinder 81. Opposite ends of the impression cylinder 81 each have a flange valve 88 which can rotate with respect to the impression cylinder 81. One of the flange valves 88 has an suction hole 89 which is formed therethrough while the other has a supply hole 90 which is formed therethrough. The suction hole 89 and the supply hole 90 are respectively connected to pipes 84 which extend from a suction device and an air supply device. As shown in FIG. 22, as the impression cylinder 81 rotates, the air passage 83 is adapted to provide communication between the air supply device and the suction device.

In this arrangement, during printing, the air passage 83 is made to communicate with the suction device to produce a small negative pressure through the air passage holes 82, thereby causing the printing paper P in a paper cassette 86 to be drawn against the impression cylinder 81 by suction through the air passage holes 82. This suction prevents the dislocation of the printing paper P. After completion of printing, the air passage 83 is made to communicate with the air supply device to produce a positive pressure through the air passage holes 82, thereby causing the printing paper P drawn by suction through the air passage holes 82 to be released from the impression cylinder 81.

In the above-described printing machine, the printing paper P is drawn against the outer circumferential surface of the impression cylinder 81 by suction through the air passage holes 82. Therefore, as the impression cylinder 81 rotates, the printing paper P is positively fed along the outer circumference of the impression cylinder 81. However, if the printing machine is used continuously or at high speed, the printing paper P may be drawn against the impression cylinder 1 with the leading edge of the printing paper P projecting forward from the air passage holes 82. In this case, it becomes impossible to effect printing on the projecting leading end portion. This continues to be a problem in that it is impossible to effect printing over the entire surface of the printing paper P.

SUMMARY OF THE INVENTION

It is therefore an object of the present invention to provide a sheet-fed rotary printing machine in which it is possible to significantly reduce the number of members required for feeding printing paper to the circumferential surface of an impression cylinder, with the result that the structure is simplied and the production thereof becomes easy, thereby enabling a reduction in the production cost.

It is another object of the present invention to provide a sheet-fed rotary printing machine which is capable of feeding the printing paper to the circumferential surface of the impression cylinder in exact synchronization with the rotation of the impression cylinder.

It is another object of the present invention to provide a sheet-fed rotary printing machine which is capable of accurately positioning the printing paper at a predetermined location on the impression cylinder even when printing is effected continuously or at high speed so that accurate printing is enabled over the entire surface of the printing paper.

It is another object of the present invention to provide a sheet-fed rotary printing machine having an outer circumferential surface the whole of which can be employed as a support surface for the printing paper.

It is another object of the present invention to provide a sheet-fed rotary printing machine which is capable of holding various sizes of printing paper by adjusting suction to a a suitable level.

The aforesaid objects are achieved by the present invention which provides a sheet-fed rotary printing machine comprising an impression cylinder and feed means for holding by suction from above a sheet of printing paper which is stacked in the vicinity of said impression cylinder to feed said sheet of printing paper directly to a predetermined position on said impression cylinder.

Other and further objects of the present invention will be apparent from the following description of the preferred embodiments thereof, and the scope of the invention will be indicated in the appended claims. Other advantages of the invention will be readily understood by those skilled in the art by carrying out the present invention.

BRIEF DESCRIPTION OF THE DRAWINGS

FIGS. 12(*b*) is a schematic cross section illustrating the printing paper located in a print position;

FIG. 12(*c*) is a schematic cross section illustrating the printing paper located in a paper release position;

DESCRIPTION OF THE PREFERRED EMBODIMENTS

Preferred embodiments of the present invention will be described below with reference to FIGS. 1 to 19.

A first preferred embodiment of the invention will be described below with reference to FIGS. 1 to 5.

Figure 1:
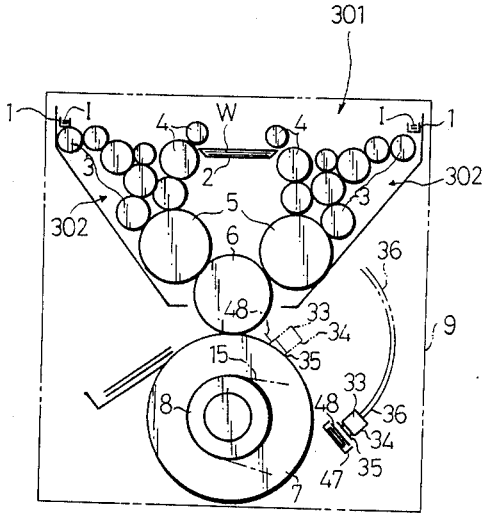
FIG. 1 is a schematic front elevation of a first preferred embodiment of the present invention.

FIG. 1 is a schematic illustration of the whole of a sheet-fed rotary printing machine constituting the first embodiment of the invention. As illustrated, a printing unit 301, which is disposed in an upper portion of the machine, includes two printing sections 302 which are disposed adjacent to each other. The printing sections 302 have substantially the same arrangement so that they can effect simultaneous two-color printing. Each of the printing sections 302 includes an ink storage portion for storing ink I, an ink supply portion constituted by a plurality of inking rollers 3, a plate cylinder 5 having a plate attached to its outer periphery, and moistening rollers 4. In each of the printing sections 302, water W is supplied from the water storage portion 2 via the moistening rollers 4 to the inking rollers 3, and the ink I supplied from the ink storage portion 1 is kneaded with the water W by the rotation of the inking rollers 3. The thus-kneaded ink I is spread over the surface of the plate attached to the plate cylinder 5.

A blanket cylinder 6 is rotatably disposed in contact with lower portions of the outer circumferences of the plate cylinders 5, that is, in contact with the surfaces of the plates at lower positions on the outer circumferences of the plate cylinders 5. The blanket cylinder 6 has the same diameter as the plate cylinders 5. The bottom of the blanket cylinder 6 is maintained in contact with the top of an impression cylinder 7. The impression cylinder 7 is rotated in contact with the blanket cylinder 6, and has a diameter twice that of the blanket cylinder 6. A paper cassette 47 is fixedly disposed in the vicinity of the impression cylinder 7, and the sheet cassette 47 contains a stack of sheets of printing paper 48.

Figure 2:
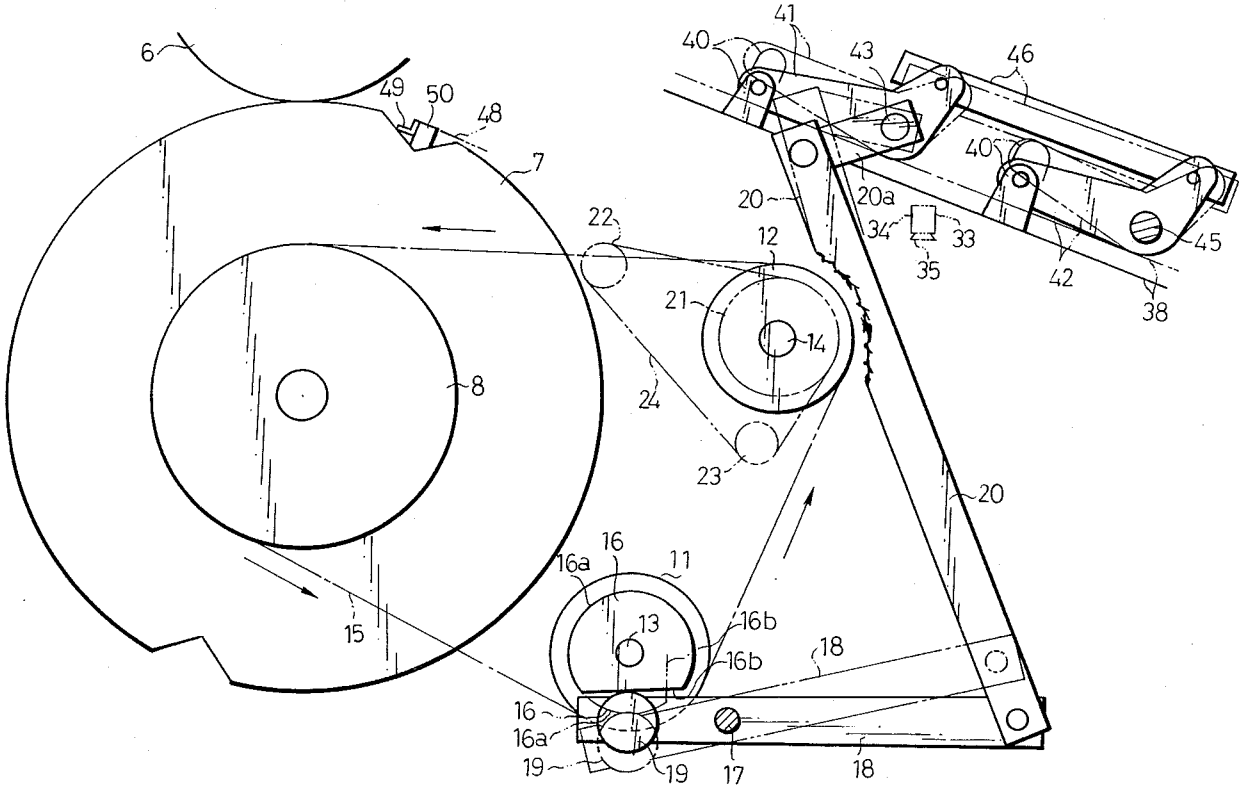
FIG. 2 is a schematic front elevation of a vertical movement mechanism for a printing-paper feeding member incorporated in the first embodiment.

Referring to FIG. 2, two pairs of a suction member 50 and a positioning member 49 are disposed at radially opposite positions on the circumference of the impression cylinder 7 (only one of these pairs is shown). A sheet of printing paper 48 is fed toward the impression cylinder 7 and is then tightly drawn against the circumference of the impression cylinder 7 by means of the suction member 50 operated by an air suction device (not shown). While it is accurately positioned by the positioning member 49, the printing paper 48 is supplied to the nip between the bottom of the blanket cylinder 6 and the top of the impression cylinder 7 to effect printing on the printing paper 48.

As shown in FIG. 2, a drive sprocket 8 is fixed to one end of the impression cylinder 7 such that they can rotate together. A first driven sprocket 11 and a second driven sprocket 12 located thereabove are fitted onto rotary shafts 13 and 14, respectively, attached to a frame 9. The drive sprocket 8, the first driven sprocket 11, and the second driven sprocket 12 are linked by an external linkage chain 15 which is arranged among them in a triangular form. Thus they are adapted to rotate in synchronization with the rotation of the impression cylinder 7.

The radius of each of the first and second driven sprockets 11 and 12 is half that of the drive sprocket 8. Thus, while the drive sprocket 8 is rotating once, the first and second driven sprockets 11 and 12 rotate twice. The drive sprocket 8, the first and second driven sprockets 11 and 12, and the external linkage chain 15 constitute in combination first timing means.

A lift cam 16 having a higher cam surface 16*a* and a lower cam surface 16*b* is fixed to the outer side of the first driven sprocket 11 so that the lift cam 16 rotates together with the first driven sprocket 11. A cam lever 18 is supported for pivotal movement by a mounting shaft 17 attached to the frame 9. One end of the cam lever 18 is provided with a rotatable cam follower 19 engaged with the outer circumference of the lift cam 16 and the other end is provided with a lift rod 20 which is moved upward and downward by the rotation of the lift cam 16. An upper end of the lift rod 20 is pivotably connected to one end of a linkage member 20*a* which extends in a direction substantially normal to the longitudinal axis of the lift rod 20. The other end of the linkage member 20*a* is capable of moving in a direction opposite to the direction in which the lift rod 20 is moved by the upward and downward movement of the lift rod 20.

A third driven sprocket 21 is coaxially attached to the inner surface of the second driven sprocket 12 such that it rotates together with the second driven sprocket 12. As shown, a fourth driven sprocket 22 and a fifth driven sprocket 23 are rotatably attached to the frame 9 on the left side of and below, respectively, the third driven sprocket 21. The third driven sprocket 21, the fourth driven sprocket 22, and the fifth driven sprocket 23 are linked by an internal linkage chain 24 to allow the driven sprocket 21 to rotate in synchronization with the impression cylinder 7. The diameters of the sprockets 8, 11, 12, 21, 22, and 23 are selected so that the speed at which the inner linkage chain 24 makes one rotation equals the speed at which the impression cylinder 7 makes a half rotation. The travel speed of the internal linkage chain 24 equals the circumferential speed of the impression cylinder 7. Therefore, while the internal linkage chain 24 is passing the outer circumference of the impression cylinder 7, the internal linkage chain 24 is at rest with respect to the impression cylinder 7.

The third sprocket 21, the fourth sprocket 22, the fifth sprocket 23, and the internal linkage chain 24 constitute in combination second timing means.

Figure 3:
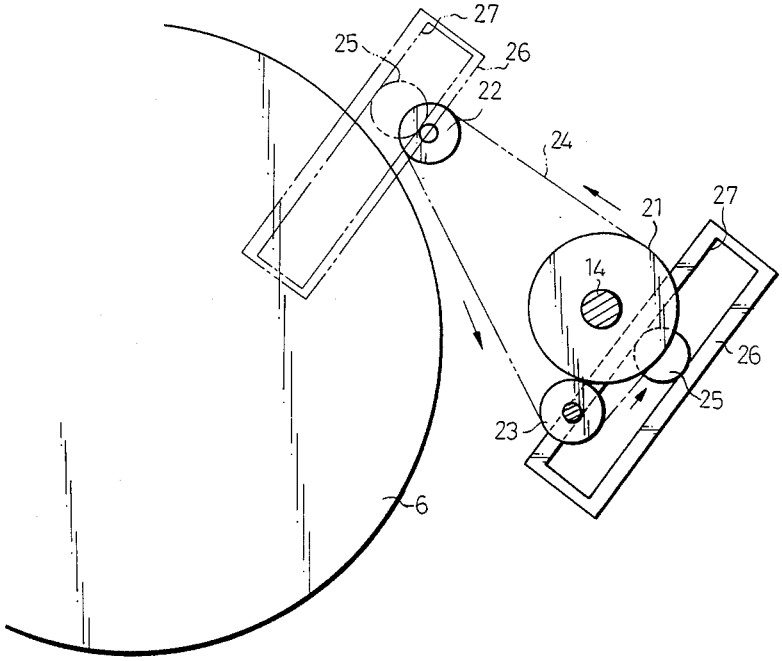
FIG. 3 is a schematic front elevation of a horizontal movement mechanism for the printing-paper feeding member incorporated in the first embodiment.
Figure 4:
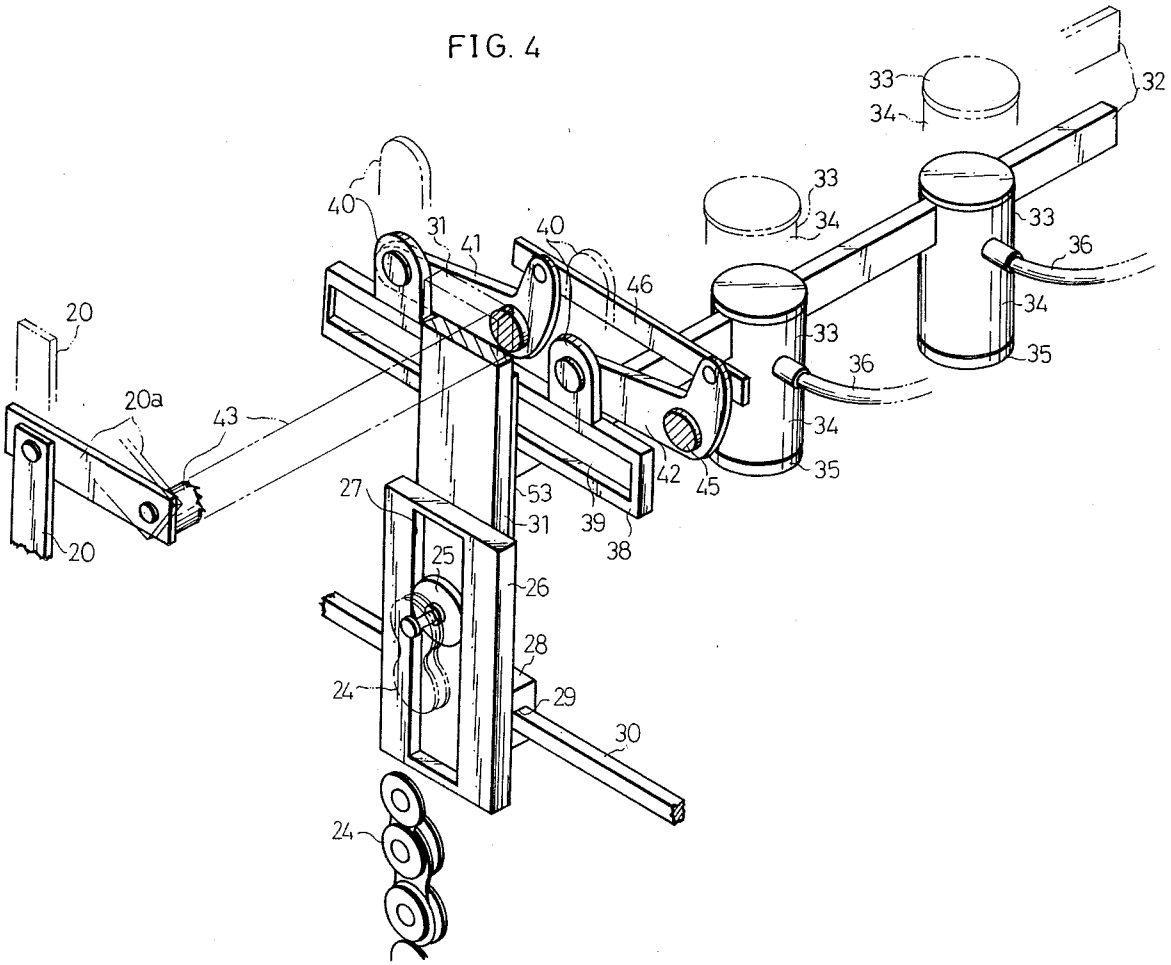
FIG. 4 is a partially broken away, enlarged perspective view of the essential portion of the sheet-fed rotary printing machine constituting the first embodiment.

As shown in FIGS. 3 and 4, a feed roller 25 is attached to the internal linkage chain 24. The internal linkage chain 24 is connected by the feed roller 25 to a vertical guide member 26 which will be described below.

More specifically, a vertical recess 27 with both ends/closed end having a rectangular shape is formed in the front surface of the vertical guide member 26. The feed roller 25 rolls within the vertical recess 27 while being held therein. A mounting member 28 is disposed at a lower portion of the reverse side of the vertical guide member 26, and a central through hole 29 extends along the longitudinal axis of the mounting member 28. The through hole 29 receives a guide rail 30 having opposite ends supported by the frame 9. Accordingly, the vertical guide member 26 is not capable of moving vertically, but it is allowed to move horizontally.

Figure 5:
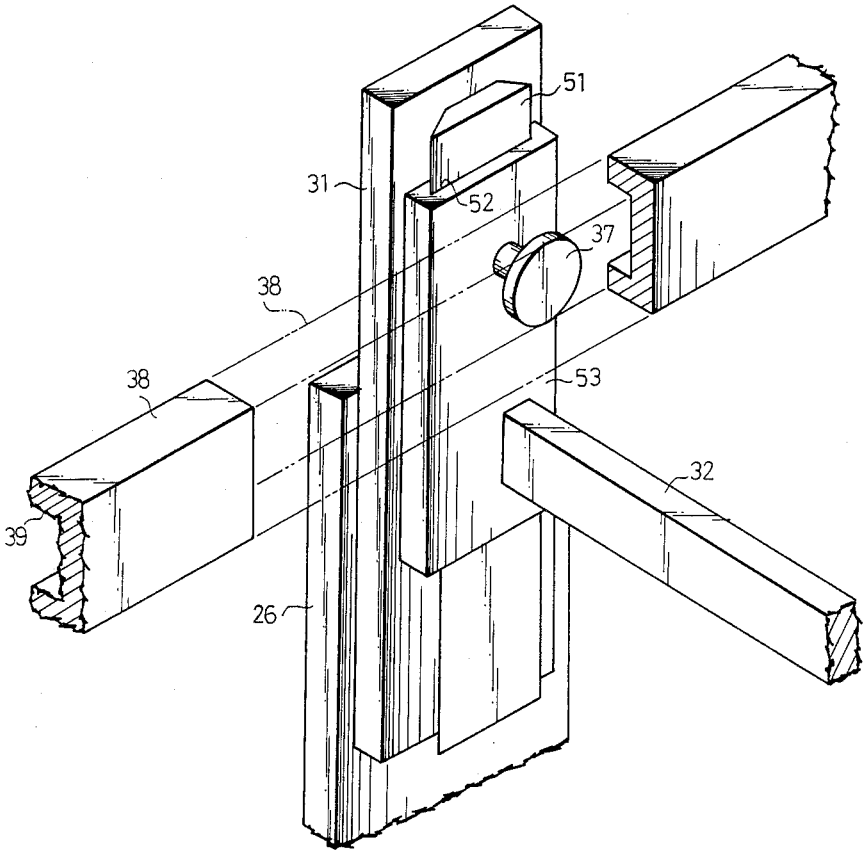
FIG. 5 is a partially broken away, enlarged perspective view of a portion of the mechanism of FIG. 4 as viewed from the reverse side thereof.

In addition, as shown in FIG. 5, a suspension member 31 is fixed to an upper portion of the reverse side of the vertical guide member 31, and the upper end of the suspension member 31 projects from the upper edge of the vertical guide member 26. The suspension member 31 together with the vertical guide member 26 (and the internal linkage chain 24) is capable of moving horizontally between an original position shown by solid lines in FIG. 3 and a near position, as shown by dot-dot-dashed lines, at which the suspension member 31 is close to the impression cylinder 6. A vertically extending guide ridge 51 having a trapezoidal cross section is formed on the reverse side of the suspension member 31. A sliding member 53 has a mounting recess 52 with a trapezoidal cross section corresponding to the cross-sectional shape of the guide ridge 51, and is fitted onto the guide ridge 51 for sliding movement in the vertical direction.

A horizontally movable roller 37 is disposed at an upper portion of the reverse side of the sliding member 53, and is adapted to roll within a horizontal recess 39 which is formed along the length of a horizontal guide member 38. Also, a mounting rod 32 is disposed on a lower portion of the sliding member 53 in such a manner as to project from the reverse side thereof. As shown in FIG. 4, a pair of feed members 33 are fixed to the mounting rod 32. Each of the feed members 33 has an air circulation chamber 34 having a cylindrical body with a closed top and a suction member 35 disposed at the bottom of the air circulation chamber 34. An upper portion of each of the air circulation chambers 34 communicates with an air supply pipe 36.

The mounting rod 32 is adapted to move vertically and horizontally together with the sliding member 53. Thus, the feed members 33 are caused to move vertically between a paper pickup position immediately above the paper cassette 47 and a feed start position further above the paper pickup position, and, in addition, to move horizontally between this feed start position and a paper release position immediately above the suction member 50 disposed in the circumference of the impression cylinder 7. The suction members 35 are adapted to selectively eject and suck air through the air supply pipes 36 and the air circulation chambers 34 by the operation of an air ejection/suction device (not shown).

A pair of spaced apart mounting projections 40 are formed on the upper edge of the horizontal guide member 38. Each of angled rotary levers 41 and 42 is rotatably attached at one end thereof to corresponding mounting projections 40. The rotary lever 41 has a bend which is integrally connected to one end of the linkage member 20a by a fixed shaft 43, while the rotary lever 42 has a bend which is supported by a support shaft 45 so as to allow the rotary lever 42 to rotate through a predetermined angle with respect to the printer frame 9.

A horizontally extending interlocking bar 46 is disposed so as to connect the upper ends of the rotary levers 41 and 42, thereby enabling integral movement of the rotary levers 41 and 42. Thus, the rotary levers 41 and 42 are capable of continuously moving reciprocally between an upper position and a lower position.

The lift cam 16, the cam lever 18, the cam follower 19, the lift rod 20, the rotary levers 41, 42, and the fixed shaft 43 constitute in combination a link mechanism for driving the aforesaid first timing means and the feed means 33 in a linked relationship. The link mechanism and the lift cam 16 constitute in combination a main vertical movement means for moving the feed members 33 upward and downward. The feed roller 25, the vertical guide member 26, the vertical recess 27, and the guide rail 30 constitute in combination a main horizontal movement means for moving the feed members 33 horizontally.

The following is a description of the operation of the sheet-fed rotary printing machine having the aforesaid arrangement.

In FIG. 2, the illustrated printing machine is shown at rest, the cam follower 19 is engaged with the lower cam surface 16b of the lift cam 16 attached to the first driven sprocket 11, and the feed members 33, shown by dot-dashed lines, are located at the paper pickup position.

As shown in FIG. 3, the vertical guide member 26 is maintained at the original position in the horizontal direction. The feed roller 25 having the internal linkage chain 24 is located at an intermediate position between the third driven sprocket 21 and the fifth driven sprocket 23.

In the above-described state, when the printing machine is started and the air ejection/suction device is caused to perform a suction operation, the suction members 35 hold by suction the uppermost sheet of the printing paper 48 contained in the paper cassette 47. As the impression cylinder 7 rotates, the first and second driven sprockets 11 and 12 are rotated via the driven sprocket 8 and the external linkage chain 15 in synchronization with the impression cylinder 7. The lift cam 16 is rotated together with the first driven sprocket 11 and, when the higher cam surface 16a engages with the cam follower 19, one end of the cam lever 18 is moved downwards, as shown by the dot-dot-dashed lines of FIG. 2, to cause the cam lever 18 to rotate counterclockwise about the mounting shaft 17, thereby causing the other end of the cam lever 18 to move upwards. This motion moves the lift rod 20 axially upwards to cause the clockwise rotation of the linkage member 20a attached to the upper end of the lift rod 20.

The rotation of the linkage member 20a is transmitted through the fixed shaft 43 to the rotary lever 41, and is further transmitted through the interlocking lever 46 to the rotary lever 42. Therefore, the rotary levers 41 and 42 are rotated clockwise about their respective bends, until they reach the positions shown by dot-dot-dashed lines. During this time, the upper ends of the rotary levers 41 and 42 are moved upwards to cause the horizontal guide member 38 to move upwards via the mounting projections 40.

The horizontally movable roller 37 held within the horizontal recess 39 in the horizontal guide member 38 is moved upwards to cause the sliding member 53 to move to an upper position. As the mounting rod 32 is moved upwards, the feed members 33 are moved to the feed start positions while holding the printing paper 48 by suction. This completes the preparation for the feeding of the printing paper 48.

While the feed members 33 are moving upwards, the rotation of the second driven sprocket 12 is transmitted to the third driven sprocket 21 to cause the fourth and fifth driven sprockets 22 and 23 to rotate counterclockwise, driven by the internal linkage chain 24. Subsequently, as the internal linkage chain 24 moves around the triangle formed by the three sprockets 21, 22, and 23, the feed roller 25 rolls upwards within a portion of the vertical recess 27 in the vertical guide member 26, the portion being restricted between the fifth and third driven sprockets 23 and 21. During this time, the vertical guide member 26 is not subjected to the action of the feed roller 25, and therefore the member 26 is maintained at a horizontally stationary position.

As the internal linkage chain 24 moves, the feed roller 25 within the vertical recess 27 in the vertical guide member 26 passes the third sprocket 21, then the portion between the third and fourth driven sprockets 21 and 22 is moved toward the impression cylinder 7 to feed the vertical guide member 26 and the suspension member 31 toward the impression cylinder 7 at a speed equal to the circumferential speed of the impression cylinder 7. During this time, the horizontally movable roller 37 slides within the horizontal recess 39 in the horizontal guide member 38 and at the same time the vertical guide member 26 moves toward the impression cylinder 7 along the guide rail 30. Therefore, the vertical guide member 26 and the suspension member 31 are smoothly moved horizontally. While the suspension member 31 is moving, the mounting rod 32 moves horizontally to cause the feed members 33 to move toward the circumferential surface of the impression cylinder 7.

Subsequently, when the feed roller 25 reaches a position close to the fourth driven sprocket 22, the feed member 33 reaches the paper release position. At this point, the air ejection/suction device is switched over from a suction state to an ejection state, and the printing paper 48 is released from the suction members 35 of the feed members 33. While being accurately positioned by the positioning member 49, the thus-released printing paper 48 is laid over the circumferential surface of the impression cylinder 7 which is at rest with respect to the suction members 35, and at the same time it is held on that circumferential surface by the suction of the suction member 50. The printing paper 48 is fed toward the blanket cylinder 6 by the rotation of the impression cylinder 7.

Subsequently, after the feed roller 25 has passed the fourth driven sprocket 22, it moves at a slant from the fourth driven sprocket 22 to the fifth driven sprocket 23. Simultaneously, the vertical guide member 26 is moved horizontally along the guide rail 30 in a direction away from the impression cylinder 7. When the feed roller 25 reaches the fifth driven sprocket 23, the vertical guide member reaches its original position. At this point, because of a mechanism associated with the external linkage chain 15, the lower cam surface **16*b* of the lift cam 16 engages with the cam follower 19. Therefore, the vertical guide member 26 moves downwards to cause the feed members 33 to return to the paper pickup position, and the above-described operation is repeated. Accordingly, the sheets of printing paper 48 contained in the paper cassette 47 are sequentially supplied to the circumferential surface of the impression cylinder 7**, and printing is effected on the thus-supplied sheets.

In the above-described embodiment, the printing paper 48 is fed directly from the paper cassette 47 to the circumferential surface of the impression cylinder 7. Therefore, intermediate parts can be omitted, and the above-described embodiment of the printing machine has a simple structure and can be easily maintained. This results in a reduction in its production cost. Also, while the suction members 35 are moving in the vicinity of the outer circumference of the impression cylinder 7, they are at rest with respect to the impression cylinder 7. Therefore, the printing paper 48 is accurately fed.

In addition, the timing means constituted by the external and internal linkage chains 15 and 24 which respectively drive the vertical and horizontal moving means for the feed members 33 are arranged to operate in synchronization with the impression cylinder 7. Accordingly, the printing paper 48 is drawn by suction and fed in synchronization with the rotation of the impression cylinder 7 so that the printing paper 48 can be fed accurately to a desired position on the circumferential surface of the impression cylinder 7.

Moreover, the paper cassette 47 is fixed, and the upper sheet of the printing paper 48 in the paper cassette 47 is held by suction by the feed members 33. Accordingly, each sheet of the printing paper 48 is positively picked up without being damaged.

Figure 6:
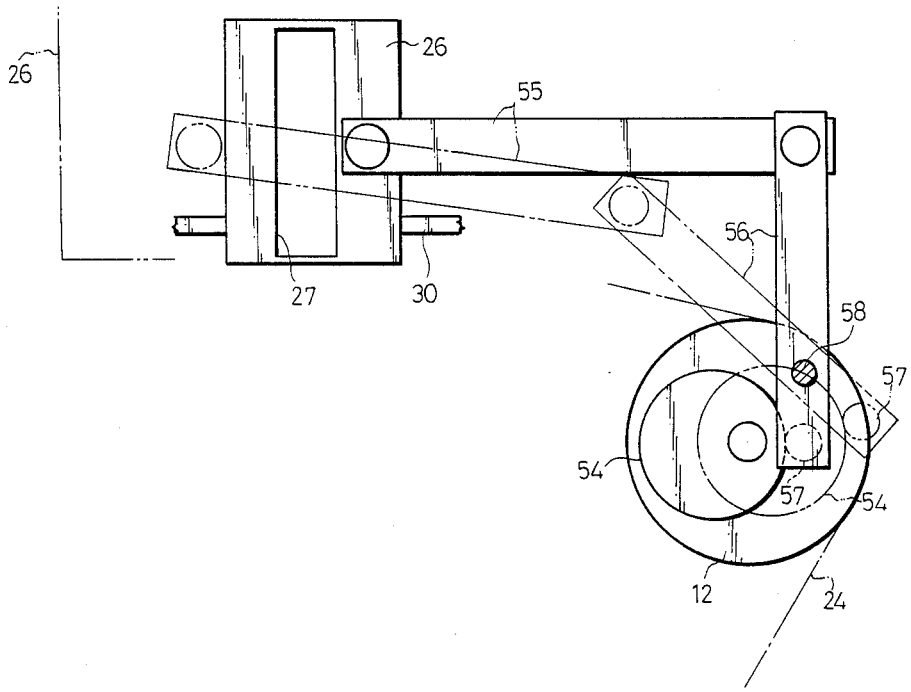
FIG. 6 is a schematic front elevation of a second preferred embodiment of the present invention.

A second preferred embodiment of the present invention will be described below with reference to FIG. 6.

The second embodiment employs a combination of a link mechanism and a cam mechanism instead of a chain mechanism, as the horizontal movement means for the feed members 33. More specifically, a drive cam 54 is coaxially attached to the second driven sprocket 12. In addition, one end of a push rod 55 is rotatably supported by the vertical guide member 26 while the other end is rotatably connected to one end of a cam lever 56. A cam follower 57, which is rotatably attached to the other end of the cam lever 56, is engaged with the drive cam 54.

As the second driven sprocket 12 rotates, the drive cam 54 is rotated counterclockwise. When a cam surface of the drive cam 54 engages with the cam follower 57, the cam lever 56 is rotated counterclockwise about a support shaft 58. Accordingly, as shown by dot-dot-dashed lines, the push rod 55 is moved toward the impression cylinder 7 to cause the vertical guide member 26 to move in the same direction along the guide rail 30.

With the above-described arrangement, it is possible to omit the internal linkage chain and the associated sprockets, thereby enabling an even simpler arrangement.

It is to be noted that the above-described embodiments may be modified as follows:

(1) The printing unit 301 may be constituted by a single printing section 302 to provide a one-color printing machine.

(2) The number of the feed members 33 may be modified as required in accordance with the size of the printing paper 48.

(3) The first timing means and/or the second timing means may be constituted by a gear train mechanism instead of a sprocket mechanism.

(4) The first timing means and/or the second timing means may be constituted by a combination of a gear and a timing belt instead of a sprocket mechanism.

(5) The speeds of the first and second timing means may be shifted from the circumferential speed of the impression cylinder 7 in such a way that only the paper release operation of the feed members 33 is performed at an accurate position.

A third preferred embodiment of the present invention will be described below with reference to FIGS. 7 to 13.

Figure 7:
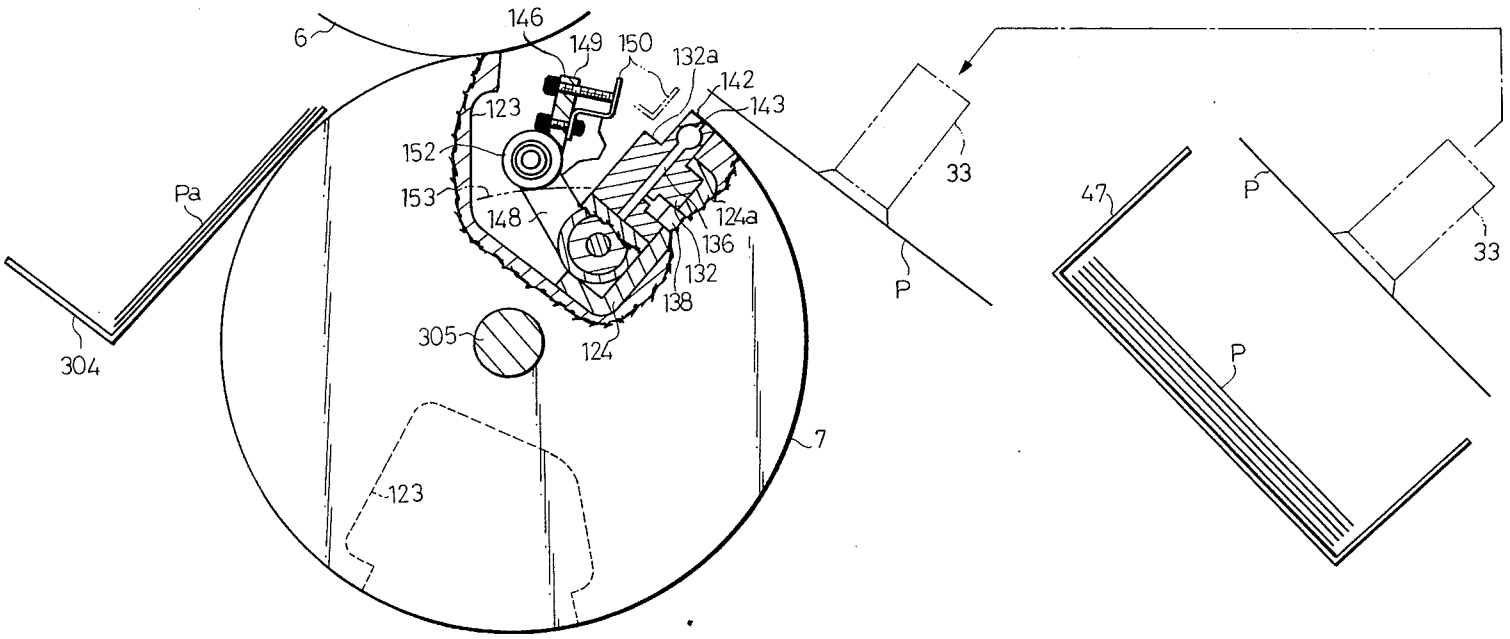
FIG. 7 is a schematic side elevation of the essential portion of a third preferred embodiment of the present invention.

The paper cassette 47 contains a stack of sheets of printing paper P which have not yet been used. The sheets of printing paper P are fed one by one from the top toward a position above a suction member, which will be described later, by means of the feed members 33 (only one of which is shown in FIG. 7).

Figure 12A:
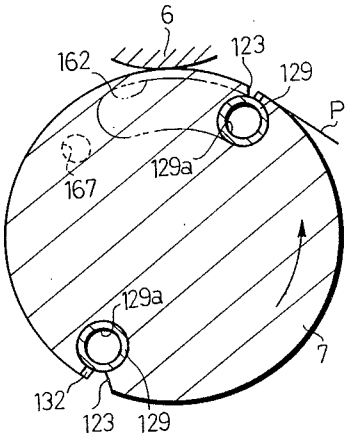
FIGS. 12(*a*) is a schematic cross section illustrating the printing paper located in a paper feed position.
Figure 12B:
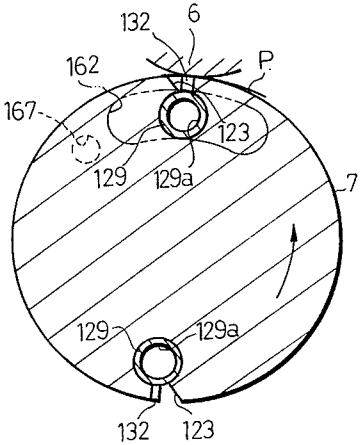
Figure 12C:
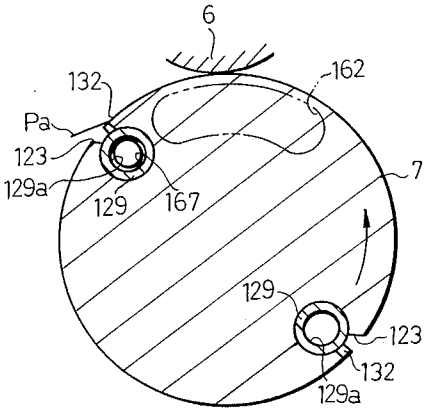

It is to be noted that the feed members 33 are moved to a fixed lowermost position. Accordingly, as they hold the printing paper P by suction to feed it, the paper cassette 47 is adapted to automatically move upward. This arrangement enables the printing paper P to be always smoothly picked up by the suction of the feed members 33. Also, as shown in FIG. 7 and FIGS. 12(*a*) to 12(*c*), when the printing paper P is fed to the impression cylinder 7, the printing paper P is fed from a paper feed point (FIG. 12(*a*)) through a print point (FIG. 12(*b*)) to a paper release point (FIG. 12(*c*)). The printing paper P is adapted to be laid on the impression cylinder 7 at the paper feed point from the paper cassette 47 by means of the feed members 33. Accordingly, the sheet of printing paper P supplied from the paper cassette 47 is placed on the impression cylinder at the paper feed point by means of the feed members 33, and the printing paper 48 is brought into contact with the outer circumference of the blanket cylinder 6 at the print point, to produce printed paper Pa. The printed paper Pa is then stored in a container 304 at the paper release point at the rear of the blanket cylinder 6.

It is to be noted that, in the third embodiment, the feed members 33 are arranged in such a manner that, when the printing paper P is located at the paper feed point, the front edge of the printing paper P projects slightly from a suction surface 142 in the direction in which the printing paper P advances. The suction surface 142 will be described later.

Figure 8:
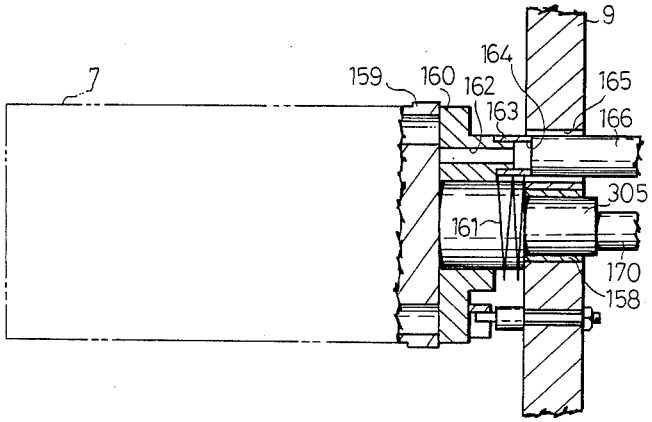
FIG. 8 is a diagrammatic cross section of the inner structure of the essential portion of an impression cylinder and a flange valve which are incorporated in the first to third embodiments.

As shown in FIG. 8, the impression cylinder 7 is made of a metal material, has a cylindrical shape, and has a rotary shaft 305 whose opposite ends (only one of which is shown) are rotatably supported by corresponding metal bearings 158 provided in the frame 9. A drive gear portion 159 is cut out of the outer circumference of a right end portion of the impression cylinder 7. While this drive gear portion 159 is rotating, the inking rollers 3, the plate cylinders 5, and the blanket cylinder 6, which constitute in combination the printing unit 301, are rotated in synchronization with one another through the intermediary of a plurality of gears (not shown).

As shown in FIG. 7, the impression cylinder 7 includes a pair of retention recesses 123 which are separated by 180 degrees circumferentially.

Figure 10:
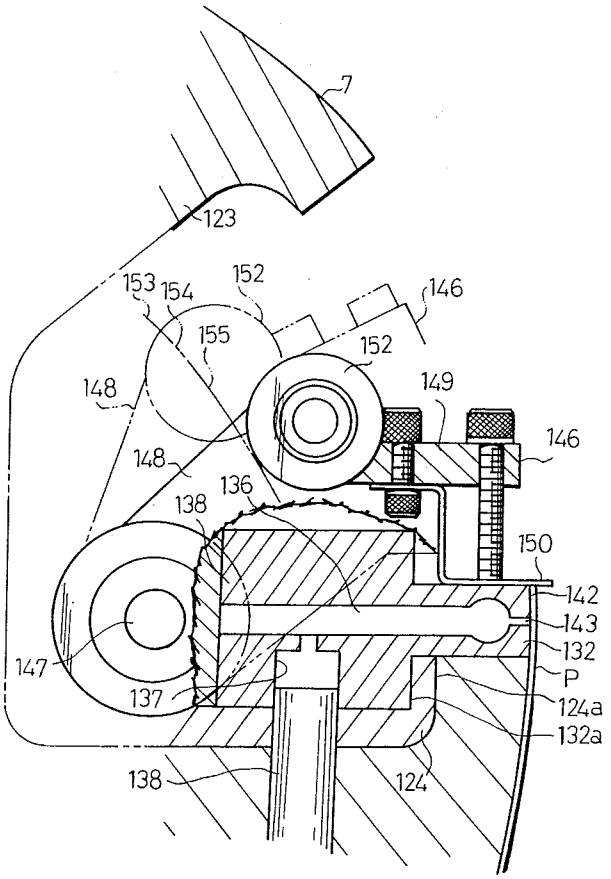
FIG. 10 is a view similar to FIG. 9 showing that the positioning member is located in its erect position.
Figure 9:
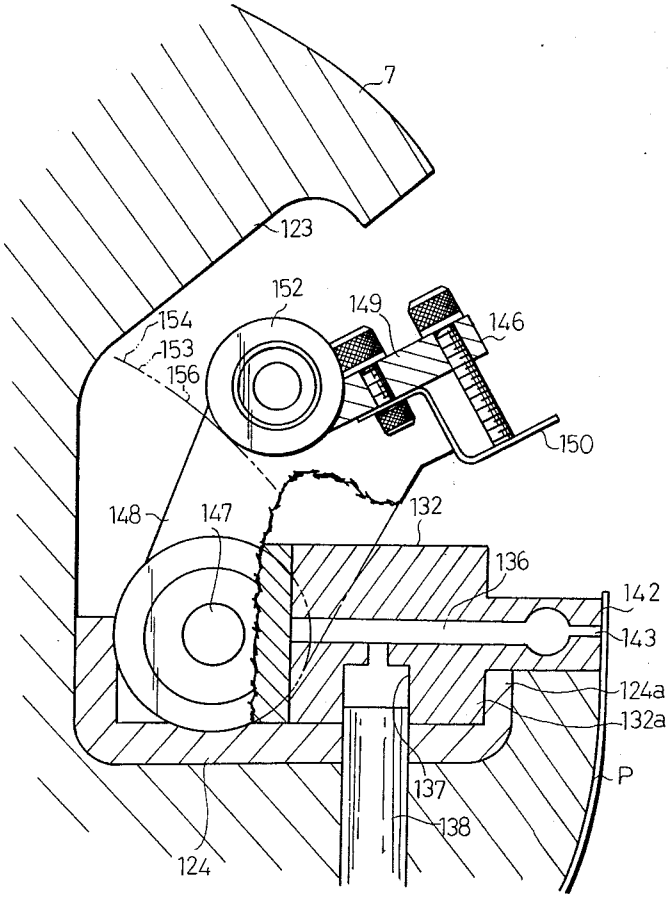
FIG. 9 is a diagrammatic enlarged cross section, with portions broken away, of a positioning member incorporated in the first to third embodiments and shows that the positioning member is located in its standby position.

As shown in FIGS. 9 and 10, a mounting wall 124 is fixed to an inner wall of each of the retention recesses 123, and a suction member 132 having a substantially T-shaped cross section is mounted on each mounting wall 124 with bolts (not shown). A step 132*a* of the suction member 132 is engaged with a flange 124*a* of the mounting wall 124, thereby preventing the suction member 132 from moving upward and downward.

An air passage 136 extends through the suction member 132 in the radial direction of the impression cylinder 7. In addition, each suction member 132 has a ventilation hole 137 which extends from a portion of the circumferential wall of the suction member 132 in a direction normal to the air passage 136. One end of the ventilation hole 137 opens into a portion of the air passage 136. As shown in FIGS. 12(*a*) to 12(*c*), pipes 129 are inserted into the portions of the impression cylinder 7 adjacent to the retention recesses 123. The pipes 129 extend along the longitudinal axis of the impression cylinder 7. One end of each of the pipes 129 opens onto one end surface of the impression cylinder 7, and communication holes 129*a* for air circulation are formed by inner walls of the impression cylinder 7 corresponding to the pipes 129. The communication holes 129*a* are connected to the ventilation holes 137 by hoses 138. Each of the suction members 132 has one end with a curved cross section which is flush with the outer circumference of the impression cylinder 7. This one end serves as a paper suction surface 142, and a suction hole 143 is formed through the paper suction surface 142. The suction hole 143 has a form such that it extends along the longitudinal axis of the impression cylinder 7 and communicates with the air passage 136.

Also, as shown in FIG. 8, a flange valve 160 is fitted onto the rotary shaft 305 at one end of the impression cylinder 7 in such a manner that the flange valve 160 can rotate with respect to the rotary shaft 305. The flange valve 160 is pressed into contact with the right end surface of the impression cylinder 7 by the action of a spring 161. A suction aperture 162 is formed in a portion of the flange valve 160 which is adjacent to the outer circumference thereof.

As shown in FIGS. 12(*a*) to 12(*c*), the suction aperture 162 extends along an arc whose center is the rotary axis of the impression cylinder 7, and the length of the suction aperture 162 equals the distance from the paper feed point to the paper release point.

Referring back to FIG. 8, a portion of the suction aperture 162 is connected to an opening 164 of a connection tube 163 which projects from the flange valve 160 toward the printer frame 9. This connection tube 163 is connected to a suction pipe 166 which is inserted through an insertion hole 165 formed through one side of the frame 9. The other end of the suction pipe 166 is connected to the air suction device (not shown) disposed in the printing machine. The air suction device is provided with a valve for adjusting the level of an air suction force. The suction force of the suction hole 143 can be adjusted in accordance with the thickness of the printing paper P.

It is to be noted that the air suction device, the flange valve 160, the suction aperture 162, and the communication holes 129*a* constitute in combination paper suction means in the suction member 132.

As shown in FIG. 7, the printing paper P is fed from the paper cassette 47 to the paper feed point by means of the feed members 33. When the paper suction surfaces 142 of the suction members 132 faces the leading edge of the printing paper P, one end of the suction aperture 162 faces the open ends of the communication holes 129. In this state, the air in the communication means is sucked by the operation of the air suction device so that the air within the suction member 132 is sucked out.

As shown in FIGS. 12(*a*) to 12(*c*), a circular supply hole 167 is formed through the flange valve 160 at a position which is slightly to the left of the suction aperture 162. A connection tube projects from the portion of the outer surface of the flange valve 160 which corresponds to the position of the supply hole 167. As shown in FIG. 8, the connection tube is connected to a supply pipe 170 which is inserted through the frame 9. The supply pipe 170 is connected to an air supply device (not shown) incorporated in the printing machine.

It is to be noted that, the air supply device, the flange valve 160, the supply hole 167, and the communication holes 129 constituted in combination the paper release means in the suction member 132.

When the printed paper Pa reaches the paper release position, an open end of the supply pipe 170 faces the corresponding open ends of the communication holes 129. Subsequently, the air supply device operates to supply air to the communication holes 129 through the supply pipe 170. Thus, air is supplied to the interior of the suction member 132. In other words, the suction member 132 holding the printing paper P by suction is advanced by the rotation of the impression cylinder 7. Thereafter, when the printing paper P reaches the paper release point, past the printing point, the printing paper P is released from its sucked state.

Figure 11:
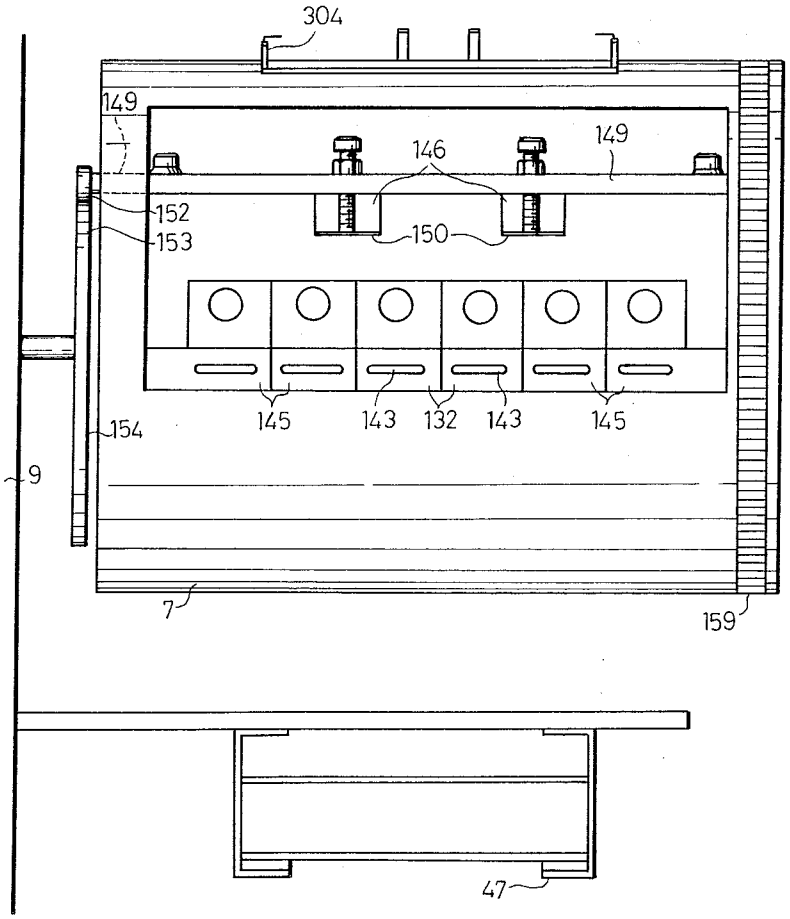
FIG. 11 is a schematic plan view of an impression cylinder in accordance with the invention.

As shown in FIG. 11, six suction members 132 are disposed side by side along the longitudinal axis of the impression cylinder 7.

As shown in FIGS. 7, 9, 10, and 11, a pair of positioning members 146 are disposed side by side in each of the retention recesses 123 in the impression cylinder 7. The positioning members 146 are capable of rotating through a predetermined angle in directions equal to and opposite to the direction of rotation of the impression cylinder 7. Each of the positioning members 146 is constituted by a support plate 148 fixed to a rotary shaft 147, a holding shaft 149 attached to one end of the support plate 148 and extending along the length of the impression cylinder 7, and an abutment plate 150 fixed to the support plate 148 and having a L-shaped cross section, one end of the abutment plate 150 projecting outwards from the outer circumference of the impression cylinder 7. A cam follower 152 is rotatably attached to one end of the support plate 148 in such a manner as to project from one end of the impression cylinder 7.

Figure 13:
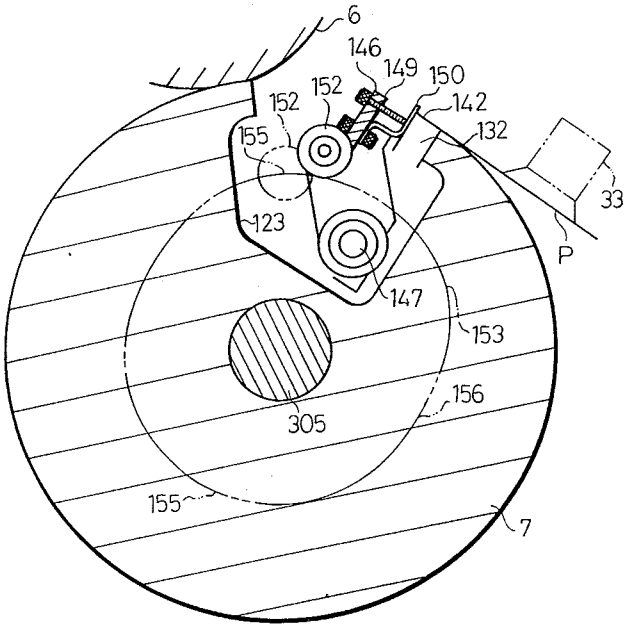
FIG. 13 is a diagrammatic cross section of a rotation device for the positioning member in accordance with the invention.

As shown in FIGS. 11 and 13, a fixed cam 153 associated with the positioning members 146 is fixed to an inner surface of the frame 9. The cam follower 152 is adapted to roll along a cam surface 154 of the fixed cam 153. The top and bottom of the cam surface 154 of the fixed cam 153 are formed into working convex cam surfaces 155. While each of the cam followers 152 linked to the positioning members 146 is rolling on the corresponding working cam surface 155, the positioning members 146 are rotated through a predetermined angle in the direction opposite to the direction of rotation of the impression cylinder 7. Thus the positioning members 146 are moved from a standby position shown in FIG. 9 to an erect position shown in FIG. 10.

The positioning members 146 are held at the erect position while the printing paper P is located at an intermediate position between the paper feed position and the printing position. During this time, the portions of the abutment plates 150 which project from the outer circumference of the impression cylinder 7 abut against the leading edge of the printing paper P so that the printing paper P is positioned. The impression cylinder 7 rotates further to cause the printing paper P to approach the blanket cylinder 6. At the moment the leading edge of the printing paper P reaches a position close to the print point, the cam follower 152 linked to the positioning members 146 reaches a non-working surface 156 of the fixed cam 153, past the working convex cam surface. Therefore, when the leading edge of the printing paper P reaches a position immediately before the print point, the positioning members 146 have already moved from the erect position to the standby position.

The following is a description of the operation of the printing machine having the above-described arrangement.

As the impression cylinder 7 rotates, the feed members 33 pick up a sheet of printing paper P from the paper cassette 47, and locate the sheet at the paper feed point. Then, as shown in FIG. 9, the feed members 33 locate the printing paper P in such a manner that the leading edge thereof is made to project slightly from the paper suction surface 142 toward the direction of movement of the printing paper P.

At this point, the communication holes 129 face one longitudinal end of the suction aperture 162 of the flange valve 160 to enable the air suction device to communicate with the suction members 132. Therefore, the air pressure in the air passages 136 formed in the suction members 132 is reduced by the suction of air which is effected through past the communication holes 129, the communication hole 138, and the ventilation hole 137.

Therefore, the printing paper P, which is fed to the paper feed point by the feed members 33, is held by suction through the suction holes 143 in a state wherein the leading edge of the printing paper P projects slightly from the paper suction surface 142. Thus the printing paper P is fed toward the blanket cylinder 6 while being held on the outer circumference of the impression cylinder 7.

The cam follower 152 linked to the positioning members 146 which is located at the standby position rolls along the cam surface 154 of the fixed cam 153. When the printing paper P reaches at a substantially mid point between the paper feed point and the print point, the cam follower 152 reaches the working convex surface 155 of the fixed cam 153. The positioning members 146 are moved from the standby position to the erect position to cause the abutment plates 150 to abut against the leading edge of the printing paper P. Subsequently, the positioning members 146 press that leading edge to move the printing paper P a slight distance in the direction opposite to the direction of rotation of the impression cylinder 7, thereby performing the positioning of the printing paper P. During this time, the level of suction force of the suction hole 143 is adjusted by a valve disposed on the air suction device. Accordingly, the printing paper P is smoothly moved and the printing paper P is prevented from being bent at its leading end. Thereafter, the positioning members 146 rotate together with the impression cylinder 7.

When the printing paper P reaches a position immediate before the print point, the cam follower 152 linked to the positioning members 146 rolls from the working convex surface 155 of the fixed cam 153 to the non-working surface of the same. The positioning members 146 move from the erect position to the standby position, and is thus released from abutment against the leading edge of the printing paper P. Subsequently, the printing paper P is fed to the print point with being held by the suction members 132. The printing paper P is subjected to printing at the print point between the impression cylinder 7 and the blanket cylinder 6. The printed paper Pa thus obtained is fed to the paper release point.

When the impression cylinder 7 further rotates, the printing paper P reaches the paper release point, at which the communication hole 129 opposes the supply hole 167 of the flange valve 160. In consequence, the air supply device communicates with the suction members 132 and thus air starts to be supplied to the suction members 132. Thus, air is ejected through the air suction hole 143 in the paper suction surface 142, and the printed paper Pa is released from the suction surface 142 by the pressure of the ejected air. Thereafter, the printed paper Pa is fed in the direction of rotation of the impression cylinder 7 and is stored in the container 304. This completes one print cycle. When the impression cylinder 7 makes a half rotation from a position at which it starts to rotate and the other retention recess 123 reaches to the paper feed point, the next print cycle starts.

In the above-described third embodiment, when the printing paper P is supplied to the impression cylinder 7 by the feed members 33, the back surface of the printing paper P is positively drawn against the impression cylinder 7 by the action of vacuum formed in the suction hole 143 of the suction member 132. Simultaneously, the position of the printing paper P is restricted by the positioning members 146 in the direction in which the printing paper P moves. Therefore, the printing paper P is always located at a predetermined position on the impression cylinder 7. Accordingly, even in the case of high-speed printing or continuous printing, accurate printing is enabled over the entire surface of the printing paper P.

Also, the printing paper P is fed in the direction of rotation of the impression cylinder 7. Therefore, a force is applied to the printing paper P in the direction of rotation of the impression cylinder 7. However, the leading edge of the printing paper P abuts against the abutment plates 150 of the positioning members 146 at an intermediate point between the paper feed point and a position immediate before the print point. Accordingly, the printing paper P is fed to the print point with the forward position of the printing paper P being positioned by the positioning members 146. In consequence, even while the impression cylinder 7 is rotating at high speed, it is possible to positively prevent the dislocation of the printing paper P which might occur during feeding. This enables printing to be effected onto a predetermined position on the printing paper P.

The paper suction surface 142 of the suction member 132 is flush with the outer circumference of the impression cylinder 7. Accordingly, the whole of the outer circumference of the impression cylinder 7 can be employed as a support surface for the printing paper P.

It is to be noted that the third embodiment may be modified as follows.

(1) The number of the suction members 132 and the positioning members 146 may be determined as desired.

(2) The paper suction surface 142 and the suction hole 143 of each of the suction members 132 may be made to project from the outer circumference of the impression cylinder 7.

(3) Instead of the plate used in the above-described embodiments, a letterpress plate or an intaglio plate may be attached to the plate cylinder 5.

(4) The paper cassette 47 may be disposed further close to the outer circumference of the impression cylinder 7 and may be arranged to move in synchronization with the rotation of the impression cylinder 7.

(5) The positioning members 146 may be omitted, and only the suction members 132 may be employed.

A fourth preferred embodiment of the present invention will be described below with reference to FIGS. 14 to 17.

Figure 14:
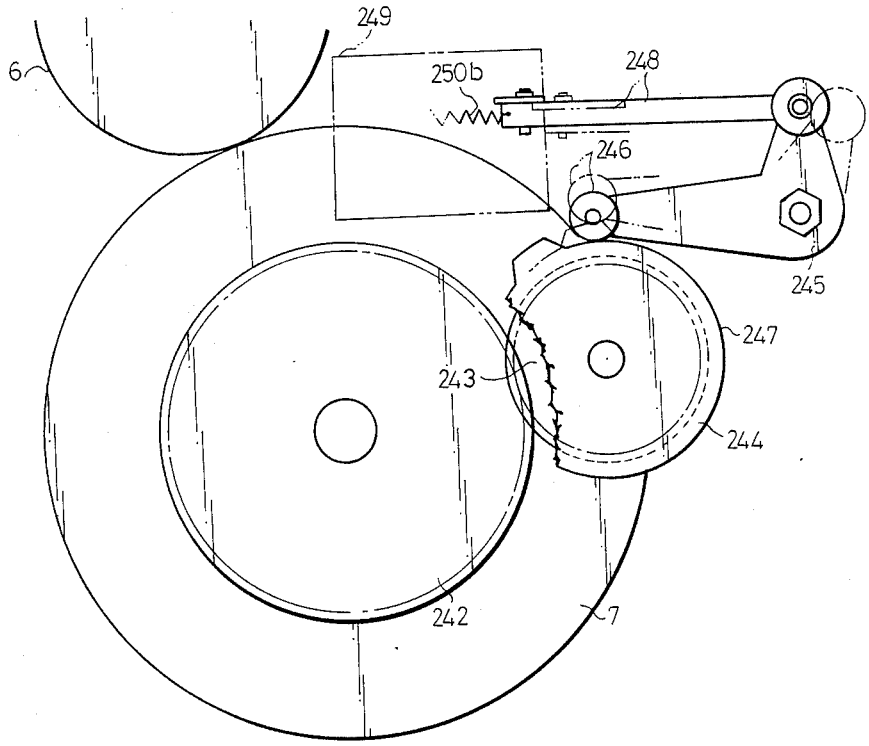
FIG. 14 is a schematic front elevation of a fourth preferred embodiment of the present invention.

As shown in FIG. 14, a drive gear 242 is attached to the end surface of the impression cylinder 7 opposite to the end provided with the drive sprocket 8, with the drive gear 242 being rotatable together with the impression cylinder 7. A driven gear 243 which is meshed with the drive gear 242 is supported by the printer frame 9. The number of teeth of the driven gear 243 is half that of teeth of the drive gear 242. A cam 244 is fixed to the outer side of the driven gear 243 for integral rotation with respect to the driven gear 243. An angled lever 245 is supported by the frame 9 above the cam 244 such that the angled lever 245 can swing, and a cam follower 246 is attached to the end of a horizontally extending portion of the angled lever 245. The cam follower 246 is engaged with a cam surface 247 of the cam 244. The angled lever 245 is capable of swinging about its substantially central bend. The upper end of an erect portion of the lever 245 is connected to one end of a reciprocally movable rod 248 which extends horizontally toward the impression cylinder 7. The other end of the movable rod 248 is provided with a direction converting member 249. The movable rod 248 is always urged toward the impression cylinder 7 by a pulling spring **250*b*, and the cam 244 and the cam follower 246 cooperate with each other in moving reciprocally between the position shown by solid lines and the position shown by dot-dot-dashed lines in FIG. 14**.

Figure 15:
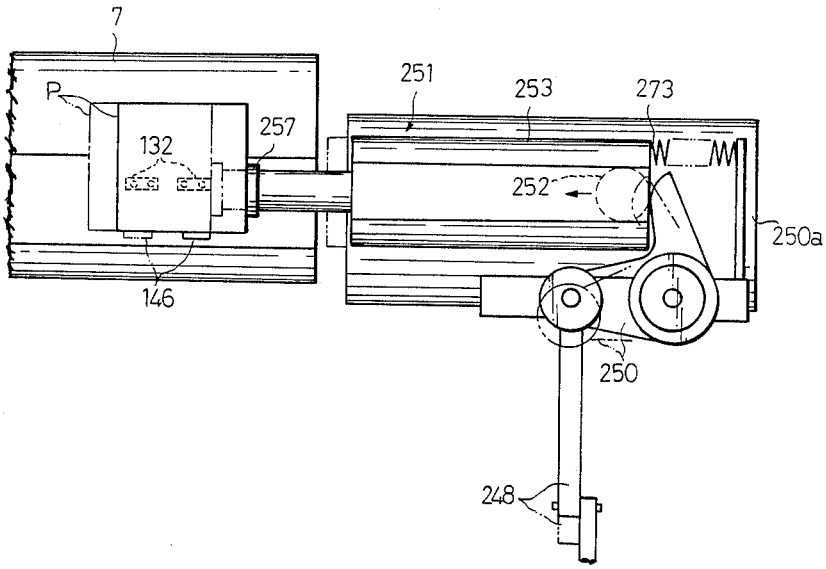
FIG. 15 is a schematic plan view of the fourth embodiment shown in FIG. 14.

As shown in FIG. 15, an angled drive lever 250 is supported rotatably about its central bend on a support table **250*a* provided on the frame 9, and one end of the drive lever 250 is attached to the other end of the reciprocally movable rod 248. The direction conversion member 249 is capable of moving reciprocally between the positions shown by solid lines and dot-dot-dashed lines in FIG. 15 by the reciprocal movement of the movable rod 248. Also, a lateral position adjustment member 251 serving as position limiting means with a rectangular form in plan view is disposed on the drive side of the drive lever 250. The other end of the drive lever 250 is engaged with a spherical rotary member 252 attached to the rear end surface of the lateral position adjustment member 251. When the drive lever 250 is rotated, it presses the lateral position adjustment member 251 toward the impression cylinder 7. The angled lever 245, the cam follower 246, the movable rod 248, and the drive lever 250 constitute in combination a link mechanism for transmitting the action of the cam 244 to the lateral position adjustment member 251**.

Figure 16:
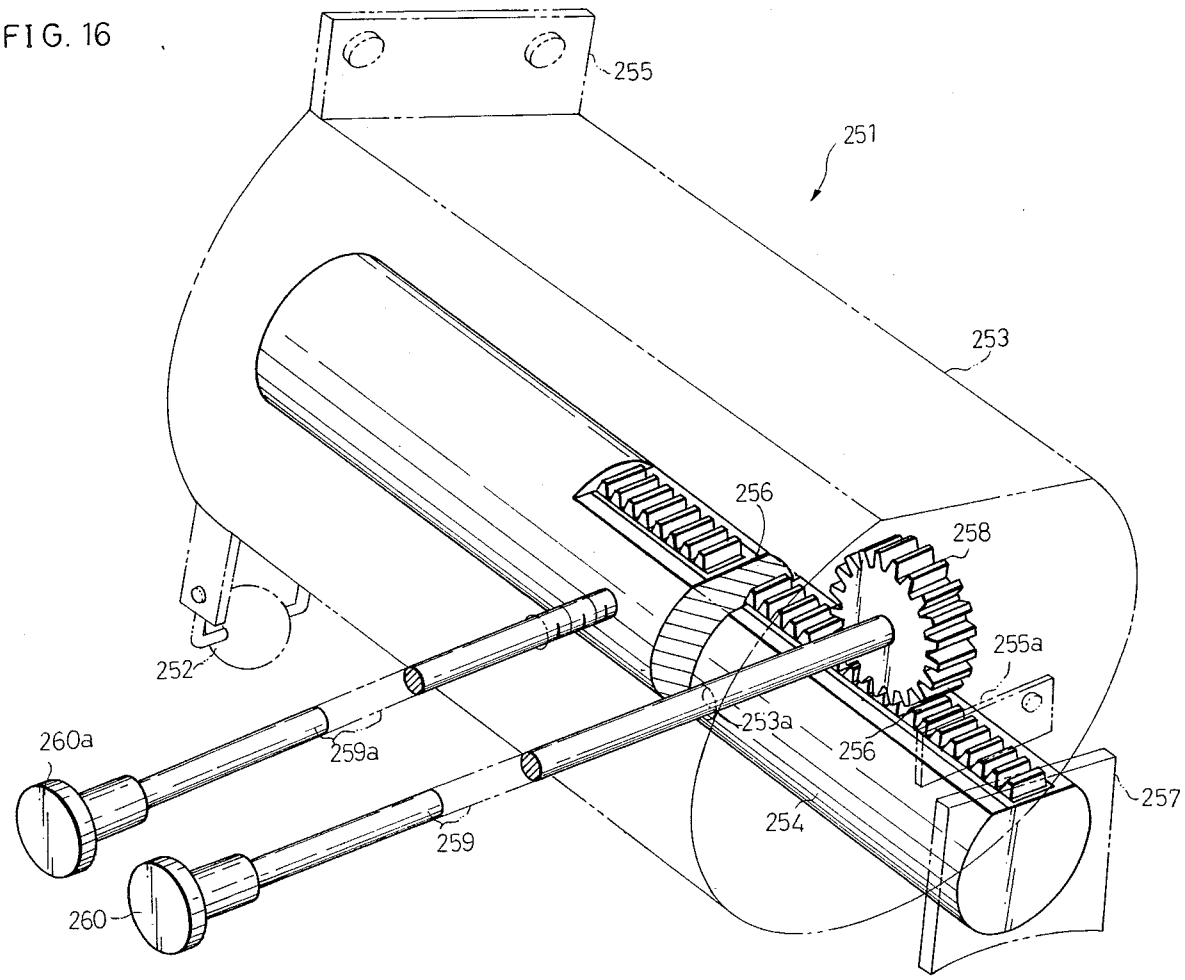
FIG. 16 is a diagrammatic perspective view illustrating a lateral position adjustment member in accordance with the invention.

As shown in FIGS. 15 and 16, the lateral position adjustment member 251 includes a generally cylindrical casing 253 attached to the printer frame 9 in such a manner as to extend from one end of the impression cylinder 7 to the axial mid portion of the same. The position adjustment member 251 is always urged by a pulling spring 273 in the direction away from the impression cylinder 7. The lateral position adjustment member 251 is arranged to move reciprocally along the longitudinal axis of the impression cylinder 7 by the action of the drive lever 250. The casing 253 includes a rack 254 which extends along the length of the impression cylinder 7. An upper portion of the casing 253 is formed in a flat shape along its entire length. A rotation preventing plate 255 is fixed to the frame 9 in such a manner that the plate 255 engages with one end of the flat portion so as to prevent the rotation of the casing 253. The rack 254 has a cylindrical form similar to that of the casing 253; and a toothed surface 256 is formed in an upper portion of the rack 254 over a length equivalent to half length of the impression cylinder 7. The portion of the rack 254 having the toothed surface 256 is made to partially project from the casing 253 to a position above the impression cylinder 7, and an abutment plate 257 is fixed to the end surface of this projecting portion of the rack 254.

It is to be noted that the abutment plate 257 is adapted to abut against one side edge of the printing paper P which is held by suction by the suction member 132, thereby pushing the printing paper P as required in the direction of the longitudinal axis of the impression cylinder 7 so as to move the printing paper P to a longitudinally predetermined position. A pinion 258 is meshed with the toothed surface 256 of the rack 254, and a rotary rod 259 is fixed to one side surface of the pinion 258. The rotary rod 259 passes through an insertion hole **253*a* in the casing 253 and extends outwards of the lateral position adjustment member 251. The outward end of the rotary rod 259 is provided with a knob 260. When the knob 260 is rotated, the pinion 258 is rotated in meshed relationship with the toothed surface 256 formed in the rack 254. The rack 254 and the lateral position adjustment member 251 are moved in accordance with the direction and angle of rotation of the pinion 258. In addition, a tightening bolt 259*a* is disposed in the vicinity of and parallel to, the rotary rod 259. After the position of the rack 254 has been determined, a knob 260*a* is turned to cause the tightening bolt 259 to tighten the rack 254 until it is locked. Thus the projecting length of the rack 254** is fixed.

It is to be noted that a rotation preventing plate **255*a* is fixed to the end surface of the casing 253 through which the rack 254 extends. When the rack 254 rotates, the rotation preventing plate 255*a* engages with the toothed surface 256 to prevent the rotation of the rack 254**.

Also, as shown in FIG. 15, positioning members 146 serving as position limiting means are disposed at the front of the suction members 132 in the direction of rotation of the impression cylinder 7. After the lateral position adjustment member 251 has restricted the lateral position of the printing paper P, the positioning members 146 are adapted to limit the forward position of the printing paper P.

Subsequently, the length of the portion of the rack 254 which projects from the casing 253 is again adjusted by loosening the tighting bolt 259*a*, unlocking the rack 254, and turning the knob 260 in accordance with the size of the printing paper P. Thereafter, the printing machine is operated, and the printing paper P, fed to the outer circumference of the impression cylinder 7 by the feed members 33, is held by suction by the suction members 132, as shown by a graph of FIG. 17. In this state, the impression cylinder 7 rotates to cause the drive gear 242 to rotate counterclockwise, and the driven gear meshed therewith is rotated clockwise. Therefore, the cam 244 is also rotated clockwise to cause the cam follower 244 to roll along the cam surface 247. When the cam follower 246 engages with a projection of the cam surface 247, the lever 245 is moved to the position shown by dot-dot-dashed lines in FIG. 14 and the reciprocally movable rod 248 is moved to a retracted position. Thus, the drive lever 250 is moved to the position shown by dot-dot-dashed lines in FIG. 15, to push the rotary member 252 of the lateral position adjustment member 251 toward the impression cylinder 7. Accordingly, the lateral position adjustment member 251 is moved toward the impression cylinder 7 to cause the abutment plate 257 of the rack 254 to push a corresponding side edge of the printing paper P so as to limit the lateral position of the same. Thus, the printing paper P is held at a desired position on the impression cylinder 7 in the direction of the longitudinal axis thereof.

Figure 17:
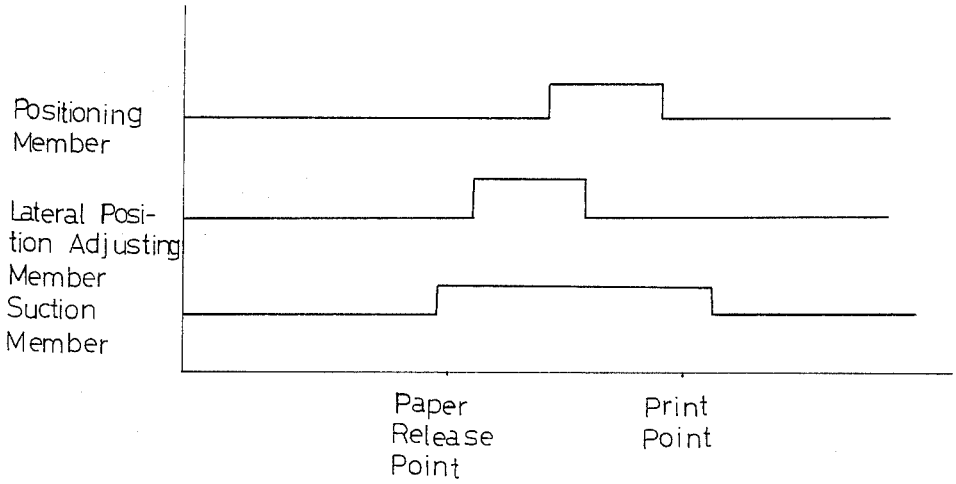
FIG. 17 is a timing chart showing the timing of driving each position limiting member for printing paper and a suction member in accordance with the invention.

Thereafter, as shown in the graph of FIG. 17, the positioning members 146 limit the forward position of the printing paper P to hold the printing paper P at a desired position.

In the above-described arrangement, on the impression cylinder 7, after the lateral position of the printing paper P has been modified, its forward position is modified. Accordingly, such position modification is achieved without dislocating the printing paper P, and the printing paper P is fed to a position at which the bottom of the blanket cylinder 6 is maintained in contact with the top of the impression cylinder 7. Accordingly, it is possible to effect printing onto an accurate position on the printing paper P.

In addition, the suction members 132 hold the printing paper P on the impression cylinder 7 by the suction of a level enough for the printing paper P to come off the impression cylinder 7. Accordingly, it is possible to prevent for this suction action to hinder the lateral and forward positions of the printing paper P.

Figure 18:
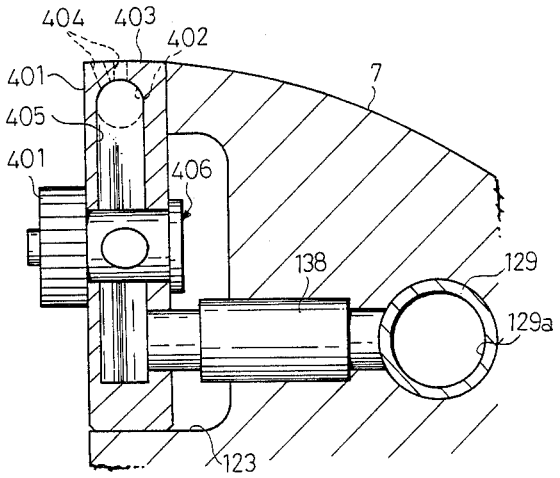
FIG. 18 is a diagrammatic enlarged view, with portions broken away, of a fifth preferred embodiment of the present invention.
Figure 20:
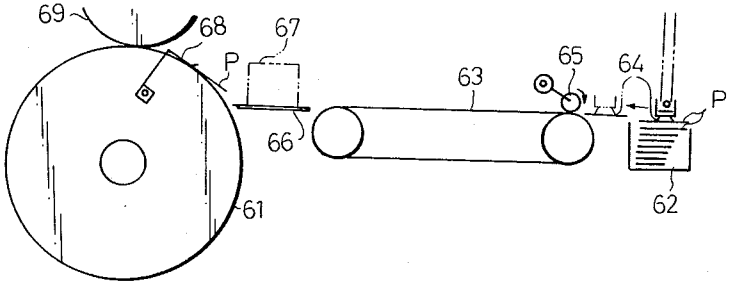
FIG. 20 PRIOR ART
FIG. 20 is a schematic front elevation illustrating a related art.

A fifth preferred embodiment of the present invention will be described below with reference to FIGS. 18 and 19 in comparison with the third embodiment.

The fifth embodiment differs from the third embodiment mainly in respect of the construction of the suction members.

Figure 19:
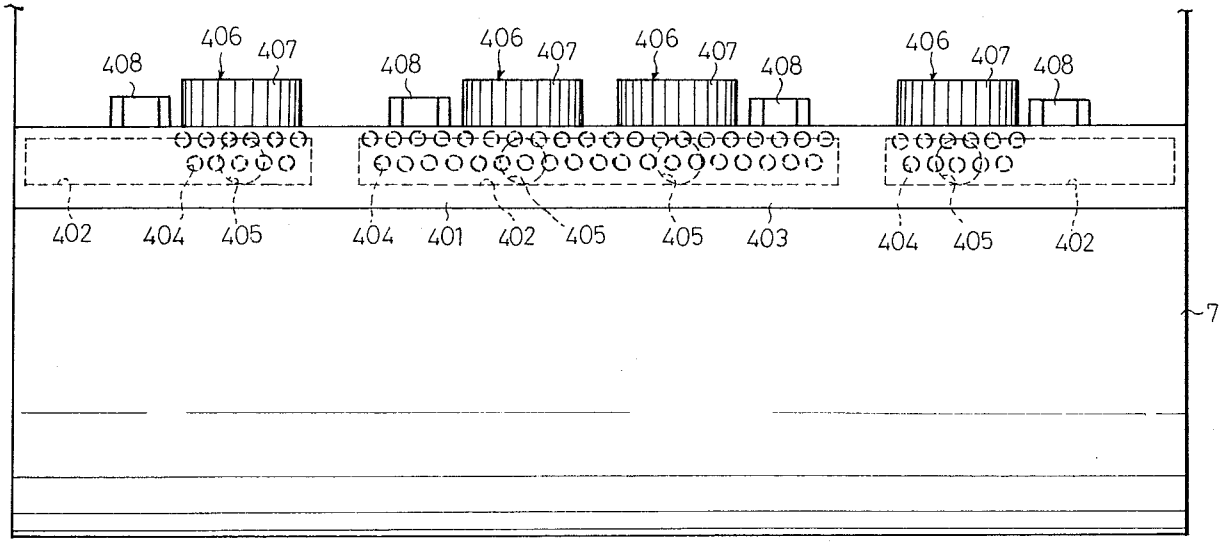
FIG. 19 PRIOR ART
FIG. 19 is a diagrammatic plan view of the fifth embodiment shown in FIG. 18.
Figure 21:
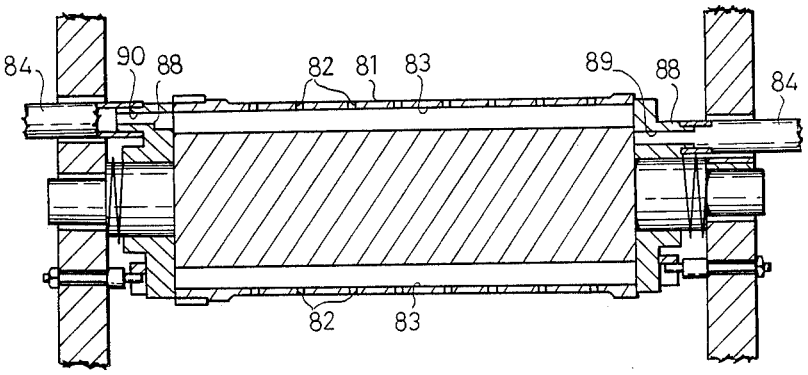
FIG. 21 PRIOR ART
FIG. 21 is a diagrammatic cross section of an impression cylinder of another related art.
Figure 22:
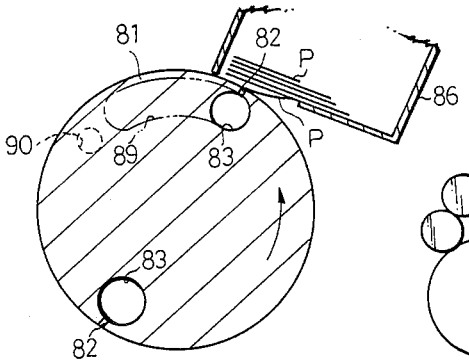
FIG. 22 PRIOR ART
FIG. 22 is a diagrammatic cross section of the impression cylinder and a paper cassette which is based on the related art of FIG. 21.
Figure 23:
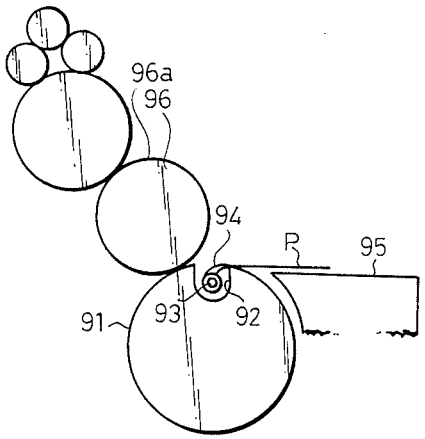
FIG. 23 PRIOR ART
FIG. 23 is a schematic front elevation illustrating still another related art.

As shown in FIG. 19, the end of a suction member 401 adjacent to the outer circumference of the impression cylinder 7 includes a plurality of (in this embodiment, three) air circulation holes 402 which extend along the length of the suction member 401. The three suction members 401 are separately disposed at the mid portion of the suction member 401 and on the opposite sides of the same. A suction holes 404 is formed through a paper suction surface 403 of the suction member 401 in correspondence with each of the air circulation holes 402. The suction member 401 includes air passages 405 which extend in the direction of the width of the suction member 401, and the air passages 405 communicate with the central and side air circulation holes 402. In this embodiment, one of the air passages 405 communicates with each of the peripheral air circulation holes 402 and two of them communicate with the central air circulation hole 402.

A lower end of each of the air passages 405 communicates with a communication hole 129*a* via the hoses 138 (only one of which is shown). As in the case of the third embodiment, the communication hole 129*a*, the hoses 138, the air passages 405, the air circulation holes 402, and the suction holes 404 cooperate with one another in holding the printing paper P by suction and in releasing the printing paper P. Each of the air passages 405 is provided with a valve 406 serving as air-flow adjustment means. The amount of the air flowing in the air passage 405 can be adjusted by turning a knob 407 attached to the valve 406.

It is to be noted that, in this embodiment, the previously-described mounting wall 124 is omitted and the suction member 401 is mounted directly to an inner wall of the retention recess 123.

In the fifth embodiment having the above-described arrangement, the level of suction which is applied through the suction holes 404 of the suction member 401 can be adjusted in accordance with the thickness of the printing paper P by adjusting the valve 406, in the same manner as in the third embodiment. In addition, various sizes of printing paper P can be held by suction by actuating or stopping the valves 406 corresponding to the opposite air circulation holes 402 since the air circulation holes 402 are separately formed in the center of and on the opposite sides of, the suction member 401.

While the above provides a full and complete disclosure of the invention, various modifications, alternative constructions and equivalents may be employed without departing from the true spirit and scope of the invention. Therefore, the above description and illustrations should not be construed as limiting the scope of the invention, which is defined solely by the appended claims.

What is claimed is:

1. A sheet-fed rotary printing machine comprising:

(a) a printing cylinder;

(b) an impression cylinder rotating in engagement with said printing cylinder;

(c) means to feed a sheet of printing paper to said rotating impression cylinder;

(d) means to hold said sheet on said impression cylinder for travel therewith; and (e) first position limiting means for laterally positioning the printing paper in the direction perpendicular to the direction of feed of said printing paper while said paper is held on said impression cylinder and before the printing paper reaches a print point between said printing cylinder and said impression cylinder.

2. A sheet-fed rotary printing machine according to claim 1, further including second position limiting means for limiting the position of said printing paper in said direction of feed, said first position limiting means and said second position limiting means cooperating with each other in limiting the position of said printing paper.

3. A sheet-fed rotary printing machine comprising:

(a) a printing cylinder;

(b) an impression cylinder rotating in engagement with said printing cylinder;

(c) means to feed a sheet of printing paper to said rotating impression cylinder;

(d) holding means on said impression cylinder for holding said sheet of printing paper on said impression cylinder for travel therewith; and (e) first position limiting means for laterally positioning the printing paper, while being held on said impression cylinder by said holding means, in the direction perpendicular to the direction of feed of the printing paper before the printing paper reaches a print point between said printer, cylinder and said impression cylinder.

4. A sheet-fed rotary printing machine according to claim 3, further comprising second position limiting means on said impression cylinder for limiting the position of the printing paper in the direction of feed, said second position limiting means comprising means for limiting the position of the printing paper in the direction of feed after said first position limiting means has laterally positioned the printing paper in the direction perpendicular to the direction of the feed.

5. A sheet-fed rotary printing machine according to claim 3, wherein said first position limiting means comprises a position adjustment member positioned adjacent to said impression cylinder in the axial direction thereof and being reciprocatingly movable between a first position separate, in the direction perpendicular to the direction of feed, from an edge of the printing paper held on said impression cylinder and a second position contacting the edge of the printing paper to adjust the position thereof.

* * * * *